United States Patent [19]

Long et al.

[11] 4,142,430

[45] Mar. 6, 1979

[54] ENVELOPE OPENER

[75] Inventors: William J. Long; Charles A. Long, Jr.; Robert L. Babanats, all of Birmingham; Larry W. Roberts, Fairfield; H. Ross Williams, Birmingham, all of Ala.

[73] Assignee: Amer-O-Matic Corp., Birmingham, Ala.

[21] Appl. No.: 826,613

[22] Filed: Aug. 22, 1977

[51] Int. Cl.[2] ..... B43M 7/02

[52] U.S. Cl. ..... 83/23; 83/35; 83/61; 83/63; 83/71; 83/256; 83/262; 83/912

[58] Field of Search ..... 83/61, 62, 63–67, 83/23, 71, 417, 262, 256, 912, 56, 408, 39, 35; 53/381 R

[56] References Cited

U.S. PATENT DOCUMENTS

| | | | |
|---|---|---|---|
| 3,116,718 | 1/1964 | Krupotich | 53/381 R |
| 3,143,100 | 8/1964 | Krupotich | 53/381 R |
| 3,238,926 | 3/1966 | Huck | 53/381 R |
| 3,301,116 | 1/1967 | Owen | 83/912 X |
| 3,822,523 | 7/1974 | Russell | 53/381 R |

*Primary Examiner*—J. M. Meister
*Attorney, Agent, or Firm*—Seidel, Gonda & Goldhammer

[57] ABSTRACT

An envelope opener comprising first, second and third shear stations for shearing three edges of an envelope in sequence one edge at a time. Each shear station sequentially aligns the envelope by contacting the edge to be sheared, shears the contacted edge, and then releases the envelope. A microcomputer monitors the advance of the envelope through and between the shear stations and causes the shear stations to cyclically align, shear and release the envelope. A peel back station downstream of the shear station peels back a panel of the envelope to expose the contents thereof. If an envelope is jammed at or between any of the stations, the microcomputer actuates a display to indicate a jam condition. The microcomputer also shuts off power to the opener to prevent damage to the envelope.

17 Claims, 23 Drawing Figures

FIG. 12
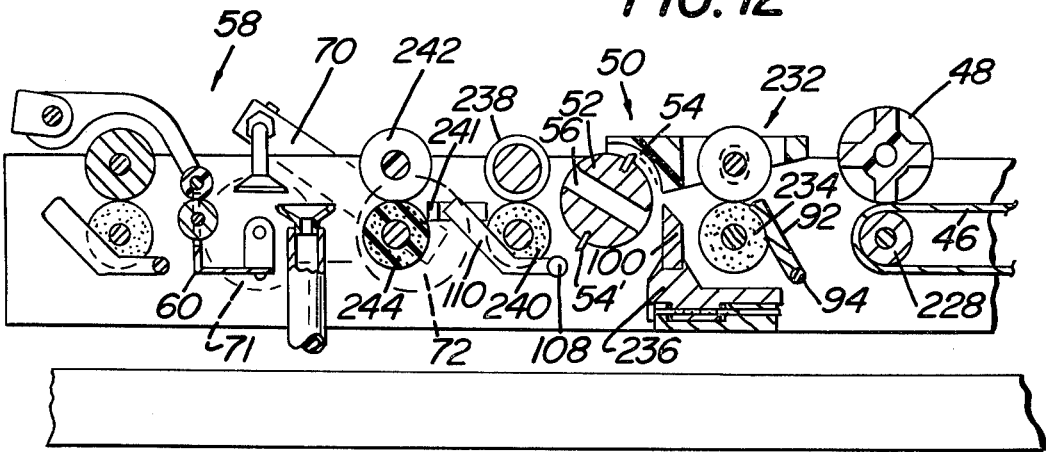
FIG. 13
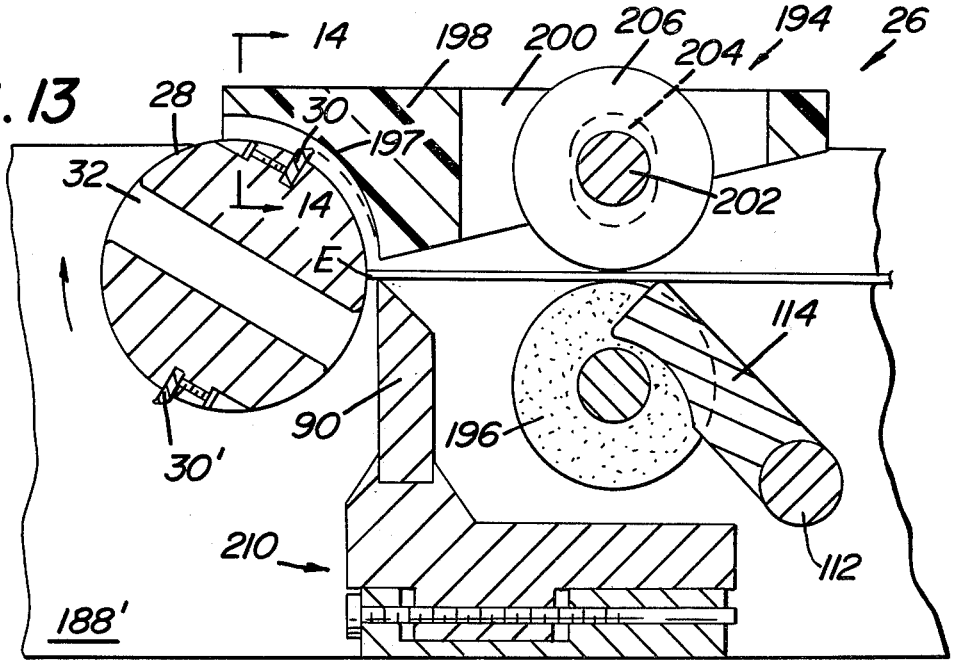
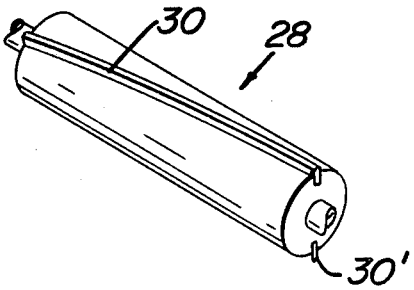
FIG. 15
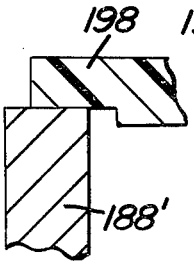
FIG. 14
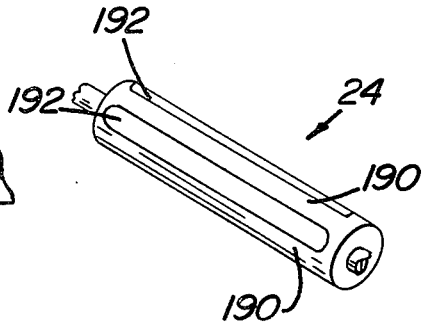
FIG. 18

AT TIME To
BLADE POISED FOR SHEAR

AT TIME Ti
SENSOR AND TIMING DISK SLOT ALIGNED

ENVELOPE OPENER

BACKGROUND OF THE INVENTION

The present invention is directed to an envelope opener. In particular, the invention is directed to an envelope opener in which three edges of an envelope are sheared one edge at a time under control of a microcomputer. The invention is further directed to an envelope opener in which an envelope is aligned for shearing by contacting the edge to be sheared rather than adjacent edges of the envelope. It is not required that any of the envelope edges by pre-weakened.

Automatic envelope openers are known in the art. For example, see U.S. Pat. Nos. 3,590,548, 3,764,049, 3,875,722 and 3,822,523. Heretofore, high speed automatic envelope openers operated at fixed rates under control of relatively primitive electro-mechanical components. In certain envelope opening machines, three edges of the envelope had to be pre-weakened before the envelope could be opened and its contents exposed. In other machines, the edge of the envelope to be sheared was aligned for shearing by contacting one or more of the remaining envelope edges. This frequently resulted in misalignment of the envelope and, accordingly, incomplete severing of the an envelope edge. In addition, such machines required cumbersome mechanical structure for guiding and aligning the envelope immediately prior to shearing.

To date, no design has been proposed for an envelope opening machine which can monitor the advance of an envelope through the machine. There has been no design proposed for such an envelope opening machine which is fully automated and continuously operated under the control of a microcomputer. There has, in particular, been no design proposed for a microcomputer controlled envelope opening machine which is capable of automatically indicated a jam condition and automatically shutting down under such condition.

SUMMARY OF THE INVENTION

An envelope opener for sequentially shearing at least three edges of an envelope and for peeling back a panel of the envelope to expose the contents thereof. The opener comprises first means for transporting at least one envelope from a feed station to a delivery point. Second means intermediate the feed station and delivery point successively aligns and shears at least three edges of the envelope one edge at a time. Third means monitors the advance of the envelope from the feed station to the delivery point. Fourth means detects whether the envelope has advanced a preselected distance over at least one of preselected interval of time and automatically disables the first and second means. After the envelope has been sheared at three edges, a panel of the envelope is peeled back to expose the contents thereof.

An advantage of the invention is that it rapidly and reliably opens an envelope without any operator intervention.

Another advantage of the invention is that each edge of the envelope is automatically and precisely aligned immediately prior to shearing.

Another advantage of the invention is that it automatically detects a jam condition and shuts down before the envelope can be torn or otherwise destroyed.

A further advantage of the invention is that it is continuously operated by state of the art microcomputer controls.

A still further advantage of the invention is that none of the envelope edges need be pre-weakened for the envelope to be opened.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 12 is a cross-section of the third shear station and the peel back station taken along the lines 12—12 in FIG. 9.

FIG. 13 s a cross-section of any shear station showing the rotatable barrel, anvil and idler means.

FIG. 14 is a cross-section of the idler means and side panel taken along the lines 14—14 in FIG. 13.

FIG. 15 is an isometric of a rotatable barrel.

FIG. 18 is an isometric of a grooved roller.

DETAILED DESCRIPTION OF THE INVENTION

Figure 1:
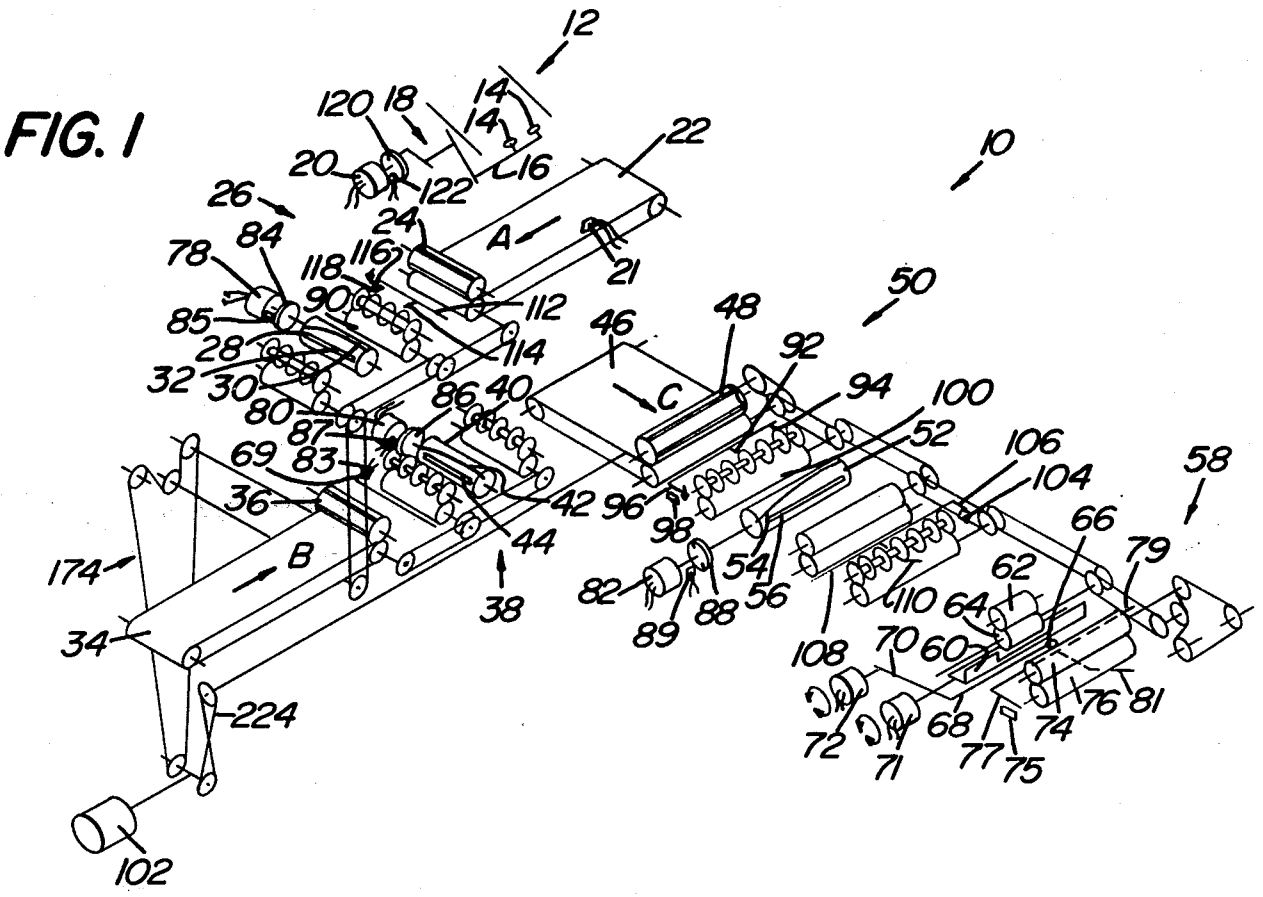
FIG. 1 is a diagrammatic representation of the envelope opener of the present invention.

Referring to the drawings in detail, wherein like numerals indicate like elements, there is shown in FIG. 1 an envelope opener 10 in accordance with the present invention. A batch of envelopes is stored in a feed station 12. Each envelope in the batch is removed from the feed station 12 by a pair of suction cups 14. The suction cups are mounted on a swingable rod 16. The rod 16 is driven through a crank 18 by a motor 20. Motor 20 is a single revolution motor. The cups 14 pick up an envelope in the feed station, the crank 18 swings the rod 16 over a conveyor 22, and the cups release the envelope to deposit the envelope on the conveyor. The conveyor 22 is driven through a chain and sprocket assembly 174 and belts and pulleys by a main drive motor 102.

The conveyor 22 transports the envelope in the direction indicated by arrow A to a grooved roller 24 which flattens any ruffles in the envelope. Thereafter, the envelope enters a first shear station 26. The station includes a rotatable barrel 28 having a pair of shear blades 30, 30' mounted on opposite sides thereof. A longitudinal opening 32 is intermediate the bades 30, 30'. The edge of the envelope to be sheared contacts the barrel 28. The barrel 28 automatically aligns the envelope for shearing in this manner. The barrel then rotates, and one of the shear blades 30, 30' contacts the leading edge of the envelope to shear the edge in cooperation with an anvil 90. Thereafter, the barrel rotates to align the opening 32 with the envelope. The envelope then passes through the opening 32.

The envelope, with its leading edge sheared, continues to travel in the direction A and falls under gravity onto a conveyor 34. Conveyor 34 is driven through chain and sprocket assembly 174 by main drive motor 102. The conveyor 34 transports the envelope in the direction indicated by the arrow B. Direction B is opposite to direction A. Accordingly, the envelope edge opposite the sheared edge becomes the leading edge of the envelope. The envelope passes under a grooved roller 36 identical to roller 24. The roller 36 flattens the envelope and feeds it to a second shear station 38 identical in structure and operation to first shear station 26.

The second shear station contacts a rotatable barrel 40 identical to barrel 28. Barrel 40 is provided with a pair of shear blades 42, 42' mounted on opposite sides of a longitudinal opening 44. The leading edge of the envelope contacts the barrrel 40 to align the envelope. The barrel rotates to shear the leading edge of the envelope in cooperation with an anvil identical to anvil 90, and rotates to align the opening 44 with the envelope as already described in connection with first shear station 26. The envelope then passes through the opening 44 to a conveyor 46. Conveyor 46 is driven through a twisted belt by main drive motor 102.

Conveyor 46 transports the envelope in the direction indicated by arrow C. Direction C is transverse to and preferably perpendicular to directions A and B. Accordingly, the bottom edge of the envelope between the sheared edges becomes the leading edge of the envelope. The envelope passes under a grooved roller 48 identical to rollers 24 and 36. Roller 48 flattens the envelope and feeds it to a third station 50. Third shear station 50 aligns and shears the leading edge of the envelope in the same manner as shear stations 26 and 28. The leading edge of the envelope contacts a rotatable barrel 52 identical to barrels 28 and 40. The barrel is provided with a pair of shear blades 54, 54' mounted on opposite sides of a longitudinal opening 56. The barrel aligns the envelope, shears the leading edge of the envelope, and rotates to align the opening 56 with the envelope. The envelope passes through the opening to a peel back station 58.

At the peel back station 58, a gate 60 is raised under control of a solenoid 71 to arrest the envelope while the top panel of the envelope is lifted or peeled back. The envelope moves through rollers 62 and 64 into position between suction cups 66 and 250. Suction cup 66 is mounted on a rod 68 connected to linkage arm 70 driven eccentrically by a motor 72. Suction cup 250 is stationary. Suction cup 66 grips the top panel of the envelope and suction cup 250 grips the bottom panel. Suction cup 66 is lifted and swung against the direction of movement of the envelope to peel back the top panel of the envelope and expose the contents thereof. The opened envelope passes through rollers 74 and 76 to the delivery end of the machine.

Figure 2:
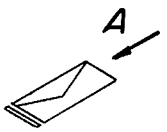
FIGS. 2–5 show a preferred sequence for shearing three edges of an envelope and peeling back a side of the envelope to expose the contents thereof.
Figure 3:
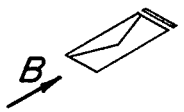
Figure 4:
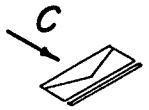
Figure 5:
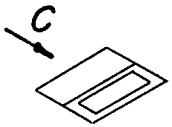

The sequence in which the envelope edges are sheared at the first, second and third shear stations 26, 38 and 50 is shown in FIGS. 2–4. The envelope, with the top panel peeled back by the peel back station 58, is shown in FIG. 5.

Timing

Figures 19, 20, 21:
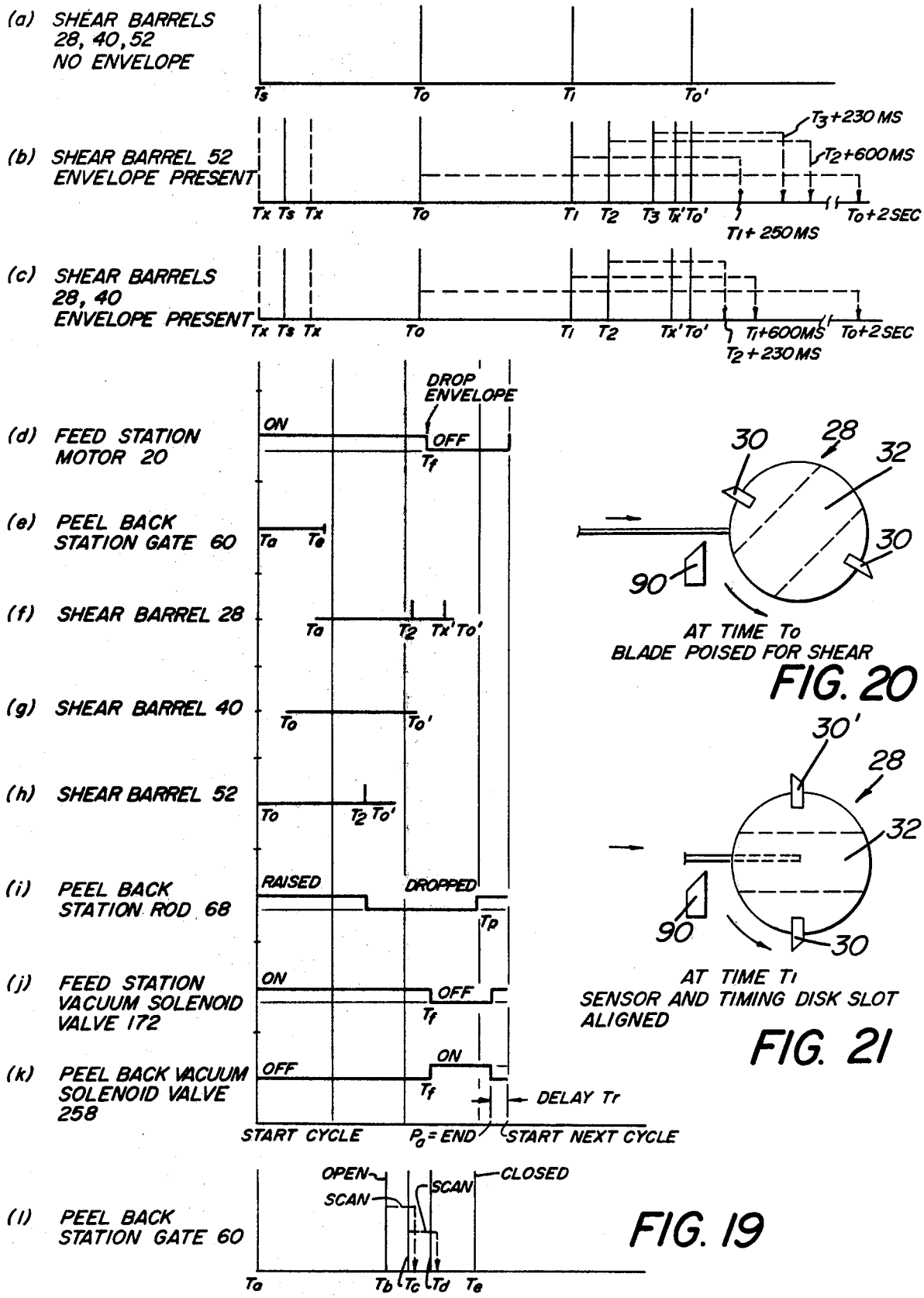
FIG. 19 is a timing diagram showing the cyclic operation of the envelope opener.
FIGS. 20 and 21 show two positions of the rotatable barrel at the times indicated in FIG. 19.

The timed operation of the components of envelope opener 10 is shown in FIG. 19.

Each of the shear station barrels 28, 40 and 52 is driven by a separate motor under control of a microcomputer described hereinafter. Barrel 28 is driven by motor 78. See FIG. 1. Barrel 40 is driven by motor 80. Barrel 52 is driven by motor 82. Motors 78, 80 and 82 are reversible motors. Each motor drives a timing disk in synchronism with the associated barrel. Timing disk 84 is driven by motor 78. Timing disk 86 is driven by motor 80. Timing disk 88 is driven by motor 82. Each timing disk is associated with a lamp and a light sensor disposed on opposite sides of the disk in proximity to the circumferential edge of the disk. Sensor 85 is associated with disk 84. Sensor 87 is associated with disk 86. Sensor 89 is associated with disk 88. Each disk is provided with a pair of diametrically opposed slots along its circumferential edge. A slot permits the passage of light from the lamp to the sensor when the slot and the sensor are in alignment. Intermediate the slots, however, the disk blocks light from reaching the sensor. The disk slots and sensors, therefore, serve to indicate the angular position of the barrels 28, 40 and 52.

A. Timed Operation Of Shear Station With No Envelope Present

On the application of power to envelope opener 10, each of the barrels 28, 40 and 52 is rotated to set the barrel up for operation. The rotation of the timing disks and barrels in the set-up sequence is shown in chart (a) in FIG. 19 for the condition of no envelope present at the shear station. For purposes of explanation, the timed operation of shear station 27 only is described. It should be understood, however, that the timed operation of shear stations 38 and 50 is the same for the condition of no envelope present.

At time Ts following the application of power, a slot on timing disk 84 moves into alignment with sensor 85. The sensor relays this information to the microcomputer by a change in output. The microcomputer causes the motor 78 to drive barrel 28 to the position shown in FIG. 20. The barrel reaches this position at time T0. The barrel is driven at approximately 45 rpm. The interval Ts-T0 is approximately 230 milliseconds. Thus, the interval Ts-T0 is fixed by the angular position of the slot on disk 84 compared with the angular position of barrel 28 as well as the speed at which the barrel is driven.

At time T0, the barrel 28 is in position to shear an edge of an envelope although none is present. See FIG. 20. The opening 32 and the shear blade 30 will poised for shearing. Since no envelope is present, the microcomputer causes the motor 78 to continue to rotate the barrel 28. Blade 30 rotates past the stationary anvil 90 while opening 32 moves into lateral alignment. See FIG. 21. The opening is aligned in this position at time T1. The time interval T0-T1 is approximately 400 milliseconds. At time T1, the opposite slot on the disk moves into alignment with the sensor. The microcomputer detects this condition and causes motor 78 to maintain the barrel stationary.

Prior to the time T0, the presence or absence of an envelope at the station is detected by a microswitch 118 associated with barrel 28 as disclosed in greater detail hereinafter. See FIG. 1. The microswitch relays this information to the microcomputer. If no envelope is at the shear station, the microcomputer causes motor 78 to rotate barrel 28 after briefly hesitating at time T1. See chart (a) in FIG. 19. Shear blade 30' travels to the position wherein it is poised above the anvil 90. The blade reaches this position at time T0'. The time interval T1-T0' is approximately 230 milliseconds. The microcomputer scans the sensor 85 and the microswitch and supervises motor 78 to drive barrel 28 as described above in repetitive cycles until an envelope is detected at the shear station.

B. Timed Operation of Shear Station 50 With Envelope Present

Chart (b) of FIG. 19 shows the timed operation of third shear station 50 when an envelope in present at the shear station. The timed operation of shear station 50 with an envelope present is similar to that of operation of shear stations 26 and 38 but is somewhat more involved. The operation of shear stations 26 and 38 may be considered a special case of the operation of station 50 as will become apparent from the following description.

As the envelope travels in the direction C, its leading edge depresses a feeler arm 92 secured to a rotatable shaft 94 upstream of the barrel. See FIG. 1. This causes the shaft to rotate. As the shaft rotates, an actuator arm 96 secured to an end of the shaft triggers a microswitch 98. The microswitch is scanned by the microcomputer to determine whether the envelope is present at the shear station.

The microswitch 98 detects the presence of the leading edge of the envelope at time Tx. See chart (b) of FIG. 19. Time Tx is always prior to the time T0. At the time Ts, the microcomputer detects alignment of the slot and sensor. The microcomputer causes motor 82 to drive barrel 52 to the position shown in FIG. 20. The barrel reaches this position at time T0. The interval Ts-T0 is approximately 230 milliseconds as already explained. When the barrel is in this position, the leading edge of the envelope will abut against the unslotted portion of the barrel. The leading edge of the envelope will be precisely aligned with the surface of the barrel at this time. No other structure is required to align the envelope.

At time T0, the microcomputer causes motor 82 to continue to rotate barrel 52 to the position shown in FIG. 21. The barrel reaches this position at time T1. The interval T0-T1 is approximately 440 milliseconds as already explained. As the barrel rotates, shear blade 54 cooperates with an anvil 100 to shear the leading edge of the envelope. See FIG. 1. At the time T1, the longitudinal opening 56 will be in lateral alignment with the envelope. See FIG. 21. The envelope can then pass through the barrel opening. At this time, the opposite slot on disk 88 moves into alignment with the sensor 89.

Figure 22:
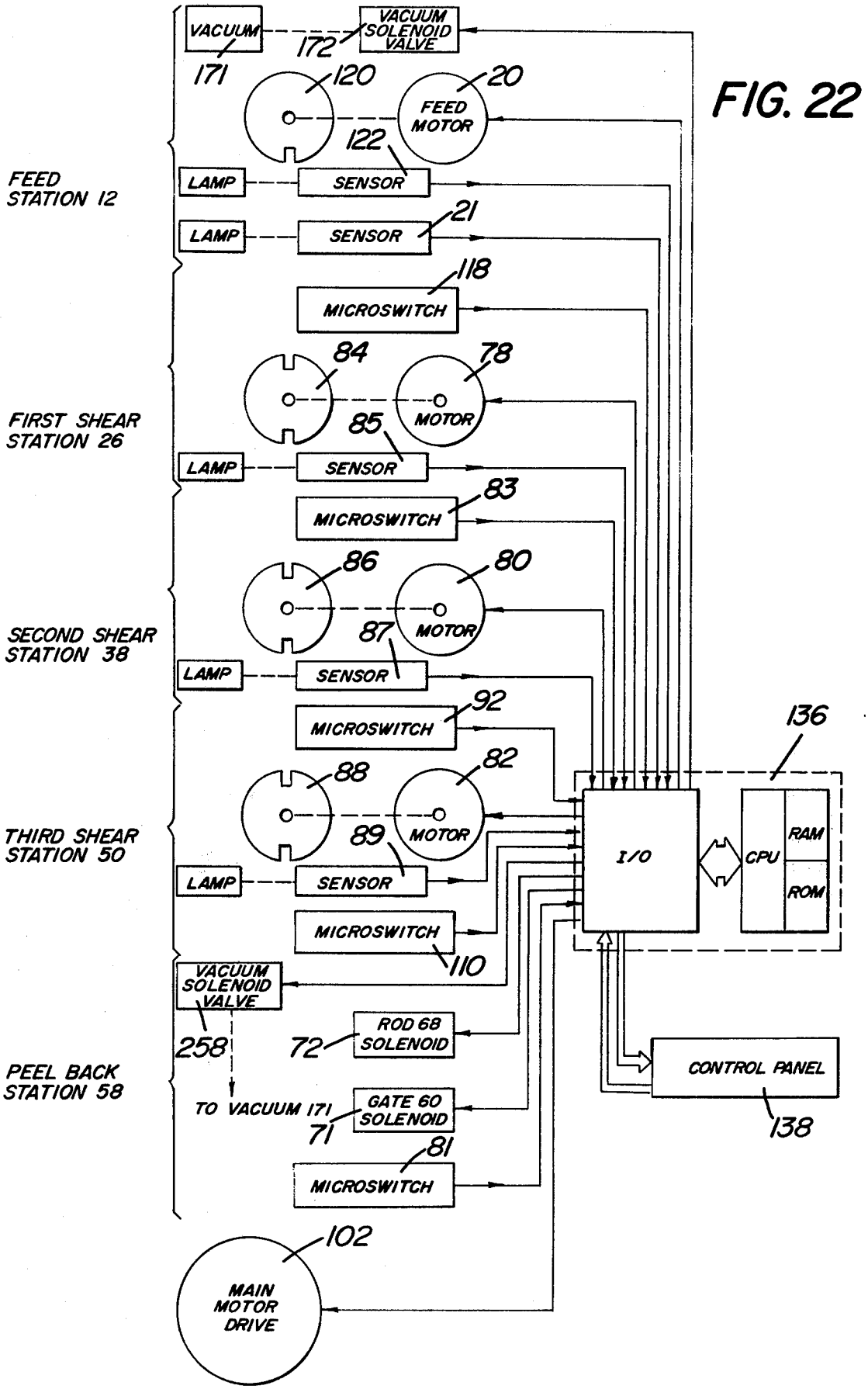
FIG. 22 is a block diagram of the microcomputer control architecture and interconnection with the sensing and drive components of the envelope opener.

The microcomputer scans sensor 89 for a 2 second window following time T0 to determine whether the second slot has moved into alignment with the sensor. Alignment of the slot and sensor occurs simultaneously with lateral alignment of the barrel opening 56. If the barrel opening has not moved into lateral alignment, the envelope will be jammed at the station. Accordingly, if the sensor output indicates that the sensor and slot are not aligned within the 2 second window, the microcomputer actuates a display to indicate a jam condition and, simultaneously, shuts off the main motor drive 102. See FIG. 1. The microcomputer also causes motor 82 to reverse direction to rotate barrel opening 56 into lateral alignment as shown in FIG. 22. The envelope can then be removed from the station for inspection.

If the second slot on the disk 88 moves into alignment with the sensor within the 2 second window, the microcomputer causes motor 82 to hesitate briefly with barrel 52 in the position shown in FIG. 21. This allows the envelope to pass through the barrel opening. The microcomputer then causes the motor to drive the barrel toward the position shown in FIG. 20 in preparation for the next shear operation.

The microcomputer scans a microswitch 104 downstream of barrel 52 to determine whether the envelope has passed through the barrel. See FIG. 1. The microswitch is operated by an actuator arm 106 securd to a rotatable shaft 108. A feeler arm 110 is secured to the shaft. If the envelope has passed through the barrel, the leading edge of the envelope will press against the feeler arm. This causes the shaft to rotate, triggering microswitch 104. The microcomputer scans the microswitch for approximately 250 milliseconds. If the envelope is jammed in barrel 52, microswitch 104 will not be triggered within the 250 millisecond window. The microcomputer detects this condition and actuates a display to indicate a jam condition while it shuts off the main motor drive 102.

If the envelope is not jammed in barrel 52, the downstream microswitch 104 will be triggered at time T2 within the 250 millisecond window. The microcomputer then scans microswitch 104 to determine whether the trailing edge of the sheared envelope has released the feeler arm 110 within a 600 millisecond window following time T2. If the envelope is jammed at the exit end of shear station 50, the trailing edge of the envelope will not reach the feeler arm 110 within the 600 millisecond window and the feeler arm will not be released. The microcomputer detects this condition and actuates a display to indicate a jam condition while shutting of the main motor drive 102.

If the trailing edge of the envelope releases the feeler arm 110 at time T3 within the 600 millisecond window, the microcomputer then scans the upstream microswitch 98 to determine whether the leading edge of a following envelope has reached shear station 50 within a 230 millisecond window following time T3. If the leading edge of a following envelope reaches the feeler arm 92 at time Tx' within the 230 millisecond window, the envelope could enter barrel opening 56 while the barrel is still being rotated to the position shown in FIG. 20. The envelope would not contact the surface of the barrel and would not be properly aligned for shearing. If the barrel continued to rotate, it could shear only part of the leading edge of the envelope and/or it could shear the entire leading edge and the contents of the envelope. If microswitch 98 indicates the presence of a following envelope within the 230 millisecond window, the microcomputer actuates a display to indicate a jam condition and shuts downk the main motor drive 102. This prevents mutilation of the envelope and/or its contents due to further rotation of the barrel.

If the leading edge of the following envelope does not reach the feeler arm 92 within the 230 millisecond window, the microcomputer causes motor 82 to continue to rotate barrel 52 to the position shown in FIG. 20. The barrel will reach this position at time T0' approximately 230 milliseconds after time T1 as already explained. The microcomputer scans microswitches 98 and 104 and sensor 89 and supervises motor 82 to drived barrel 52 as described above in repetitive cycles as successive envelopes reach the shear station.

C. Timed Operation Of Shear Stations 26 And 38 With Envelope Present

The operation of first and second shear stations 26 and 38 is substantially similar to the operation of third shear station 50. For each station, the microcomputer scans a single microswitch upstream of the station shear barrel in the same manner that it scanned the pair of microswitches 98 and 104 at the thrid shear station. The first and second shear stations 26 and 38, however, detect the presence of the leading edge of the envelope only before the edge is sheared. The presence of the leading edge is not detected at these stations after it is sheared.

Operation of first and second shear stations 26 and 38 with an envelope present is shown in chart (c) of FIG. 19. The structure and operation of the first and second shear stations are identical. Accordingly, operation of first shear station 26 only will be described.

First shear station 26 includes a rotatable shaft 112 provided with a feeler arm 114 and an actuator arm 116. See FIG. 1. The actuator arm 116 operates a single microswitch 118 upstream of barrel 28. The leading edge of an envelope depresses the feeler arm 114, causing shaft 112 to rotate. Actuator arm 116 triggers microswitch 118. The microcomputer scans microswitch 118 to detect the presence or absence of an envelope at the shear station. If no envelope is present at the shear station, the microcomputer supervises motor 78 and barrel 28 in accordance with the timing shown in chart (a) of FIG. 19.

If an enveloped is present at the shear station, the microcomputer detects this condition at time Tx. See chart (c) in FIG. 19. Time Tx is always prior to the time T0. The microcomputer causes motor 78 to rotate barrel 28 to the position shown in FIG. 20 as already explained. The barrel reaches this position at time T0. Thereafter, the microcomputer causes motor 78 to rotate the barrel while the microcomputer scans sensor 85 to determine whether the barrel has reached the position shown in FIG. 21. The barrel reaches this position at time T1. In this position of the barrel, the second slot of the timing disk is in alignment with the sensor. During the time interval T0–T1, the shear blade 30 cooperates with anvil 90 to shear the leading edge of the envelope.

If the barrel does not rotate to the position shown in FIG. 21 within 2 seconds following time T0, the envelope will be jammed at the barrel surface. Accordingly, the microcomputer actuates a display to indicate a jam condition and, simultaneously, shuts off the main drive motor 102.

If the barrel reaches the position shown in FIG. 21 at time T1 within 2 seconds following time T0, the microcomputer causes the barrel to hesitate briefly to permit the envelope to pass through opening 32. The microcomputer then causes motor 78 to rotate the barrel to the position shown in FIG. 20.

While the barrel hesitates briefly at time T1, the microcomputer scans microswitch 118 to determine whether the trailing edge of the envelope has released the feeler arm 114 within 600 milliseconds following time T1. If the envelope is jammed within barrel opening 32, the trailing edge will not release the feeler arm within the 600 millisecond window. The microcomputer detects this condition via microswitch 118. Accordingly, the microcomputer actuates a display to indicate a jam condition and, simultaneously, shuts off the main motor drive 102.

If the envelope has passed through barrel opening 32, the trailing edge will release feeler arm 114 at time T2 within the 600 millisecond window. The microcomputer then scans the microswitch 118 to determine whether the leading edge of a following envelope has reached the feeler arm 114 within 230 milliseconds after time T2. During this time the barrel 28 is being rotated to the position shown in FIG. 20. The barrel will reach this position at time T0'.

If the leading edge of a following envelope reaches the feeler arm 114 at time Tx' within the 230 millisecond window following time T2, the envelope may enter barrel opening 32 as the barrel is being rotated. Accordingly, the microcomputer actuates a display to indicate a jam condition and, simultaneously, shuts off the main motor drive 102. The microcomputer scans microswitch 118 and sensor 85 and supervises motor 78 to drive barrel 28 as described above in repetitive cycles as successive envelopes reach the shear station.

D. Machine Cycle

Charts (d)-(k) in FIG. 19 show the operation of feed station 12, shear stations 26, 38 and 50, and peel back station 58 during one machine cycle. The machine cycle is repeated at a preselected rate as described hereinafter. The operation of the feed, shear and peel back stations during a machine cycle is controlled by the microcomputer. At the start of the machine cycle, the microcomputer causes a vacuum 171 to apply suction pressure to cups 14 on rod 16 via a solenoid valve 172. See FIGS. 1 and 22 and chart (j) of FIG. 19. The cups 14 grip an envelope in the feed station. The microcomputer causes the feed station motor 20 to swing rod 16 away from the feed station via crank 18.

Motor 20 drives timing disk 120 in synchronism with crank 18. The timing disk is provided with a single slot along its circumferential edge. A lamp and a light sensor 122 are disposed on opposite sides of the timing disk in proximity to the circumferential edge of the disk. See FIG. 1. The slot permits the passage of light to the sensor when the slot and sensor are in alignment. If the slot and sensorf are not aligned, the disk blocks the light from reaching the sensor.

The vacuum 171 alternately supplies suction pressure to the feed station and the peel back station. While vacuum 171 applies suction pressure to the feed station via valve 172, a solenoid valve 258 connected between vacuum 171 and the peel back station cup 66 is maintained off. See FIG. 22 and charts (j) and (k) of FIG. 19. Accordingly, no suction is applied to peel back cup 66. Conversely, when solenoid valve 258 is opened to apply suction to cup 66, the solenoid valve 172 is maintained off. Accordingly, no suction is applied to feed cups 14.

When suction is applied to cups 14, the feed station motor 20 swings rod 16 to position the cups over conveyor 22. During this time, the barrels 28, 40 and 52 at the first, second and third shear stations effect a T0–T0' cycle in accordance with charts (a)–(c) in FIG. 19 as already explained. When the cups 14 are in position over the conveyor 22, the slot in disk 120 moves into alignment with sensor 122. This occurs at time Tf. See chart (d) in FIG. 19. The microcomputer scans sensor 122 to detect whether the cups are in position over conveyor 22. If the sensor indicates that the cups are in position over the conveyor, the microcomputer stops motor 20. Thereafter, if the trailing edge of the envelope at the first shear station has released microswitch 118 or, no envelope being present at the first shear station, if the shear barrel has reached the position shown in FIG. 21, the microcomputer causes feed station solenoid valve 172 to remove suction from the cups 14. See charts (d) and (j) in FIG. 19. Accordingly, the cups 14 release the envelope, and the envelope drops onto conveyor 22. At this time, the microcomputer operates solenoid valve 258 to apply suction to cups 66 and 250 so that the cups can grip the top and bottom panels of the envelope, respectively, at the peel back station 58. See chart (k) in FIG. 19.

A light sensor 21 is disposed adjacent to conveyor 22 to detect the presence of an envelope as it drops onto the conveyor. See FIG. 1. The microcomputer scans sensor 21 to determine whether the envelope has been released by the cups 14. If the envelope has not been released by the cups, the microcomputer detects this condition at the output of sensor 21 and operates a display to indicate a jam condition while disabling the main motor drive 102.

At the beginning of the machine cycle, the microcomputer operates a solenoid 71 to swing peel back station gate 60 open. See FIG. 1 and chart (1) in FIG. 19. When the gate is opened, an envelope can pass over it. Solenoid 71 is operated by the microcomputer at time Ta. See chart (1) in FIG. 19. Approximately 50 milliseconds after the solenoid is operated, the gate 60 will reach the open position. This corresponds to time Tb.

At time Tb, the microcomputer scans microswitch 75 at the peel back station for a brief interval or window to determine whether the envelope has passed through rollers 74 and 76 to the delivery end of the machine. See FIG. 1 and chart (1) in FIG. 19. The microswitch 75 is triggered by an actuator arm 77 secured to a rotatable shaft 79. The shaft 79 is provided with a feeler arm 81 which is depressed by the envelope to cause rotation of the shaft. When the shaft rotates, actuator arm 72 triggers microswitch 75. If the feeler arem has been contacted by the leading edge of the envelope at time Tc, the microswitch 75 will be triggered. The microcomputer will detect this condition and again scan the microswitch for a brief interval to determine whether the feeler arm has been released by the trailing edge of the envelope. If the trailing edge of the envelope has released the feeler arm, the microcomputer detects this condition at the output of microswitch 75 and operates solenoid 71 to swing gate 60 closed. In the closed position, gate 60 holds an envelope in position below suction cup 66 to permit the envelope to be opened. The gate 60 will reach the closed position at time Te.

The microcomputer scans microswitch 75 for very brief periods of time following the times Tb and Tc as indicated in chart (1) in FIg. 19. If the leading edge of the envelope does not trigger the microswitch within the scan interval following time Tb, the microcomputer operates a display to indicate a jam condition and shuts down the main motor drive 102. Similarly, if the trailing edge of the envelope does not release the microswitch within the scan interval following the time Tc, the microcomputer operates a display to indicate a jam condition and shuts down the main motor drive 102.

At the beginning of the machine cycle, rod 68 is maintained in an elevated position at the peel back station by means of linkage arm 70 and solenoid 72. See FIG. 1 and chart (i) in FIG. 19. When third shear station barrel 52 begins to be re-positioned for a shear at time T2, the microcomputer operates solenoid 72 to lower rod 68 via linkage arm 70. See charts (h) and (i) in FIG. 19. In the lower position of rod 68, the suction cup 66 contacts the top side of the envelope at the peel back station. At time Tf, suction is applied to cups 66 and 250 as already explained. Cup 66 grips the top panel of the envelope. Cup 250 grips the bottom panel.

Figure 6:
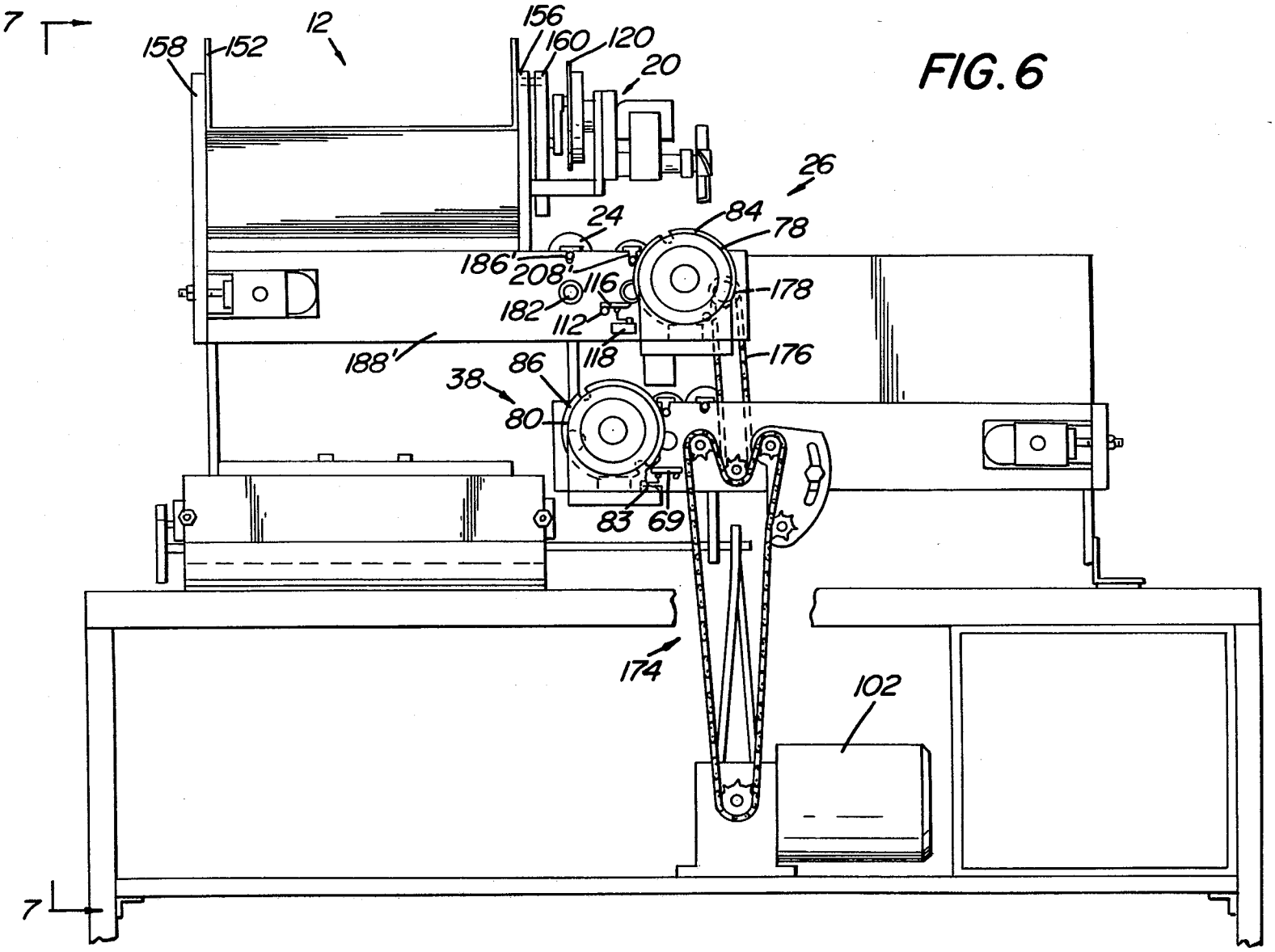
FIG. 6 is a rear view of the envelope opener.

At time Tp, the microcomputer operates solenoid 72 to raise rod 68 while suction is applied to cup 66. See FIG. 1 and chart (i) in FIG. 19. Cup 250 remains stationary. Accordingly, suction cup 66 lifts or peels back the top panel of the envelope to expose the contents of the envelope. During this time, gate 60 remains closed. See charts (e) and (1) in FIG. 19. A brief period of time after rod 68 is raised to peel back the top panel of the envelope, the peel back solenoid valve 258 is shut off and the feed station solenoid valve 172 is turned on again. Accordingly, the feed and peel back stations are prepared for the next machine cycle. When solenoid valve 258 is shut off, suction is removed from cups 66 and 250. The cups release the envelope panels. The top panel of the envelope drops onto a spring-loaded roller 260, see FIG. 6, which performs the peel back functions as described more fully below. This marks the end of the machine cycle. The rod 68 remains in the raised position, with no suction applied to cups 66 and 250 until the next machine cycle is executed.

Figure 17:
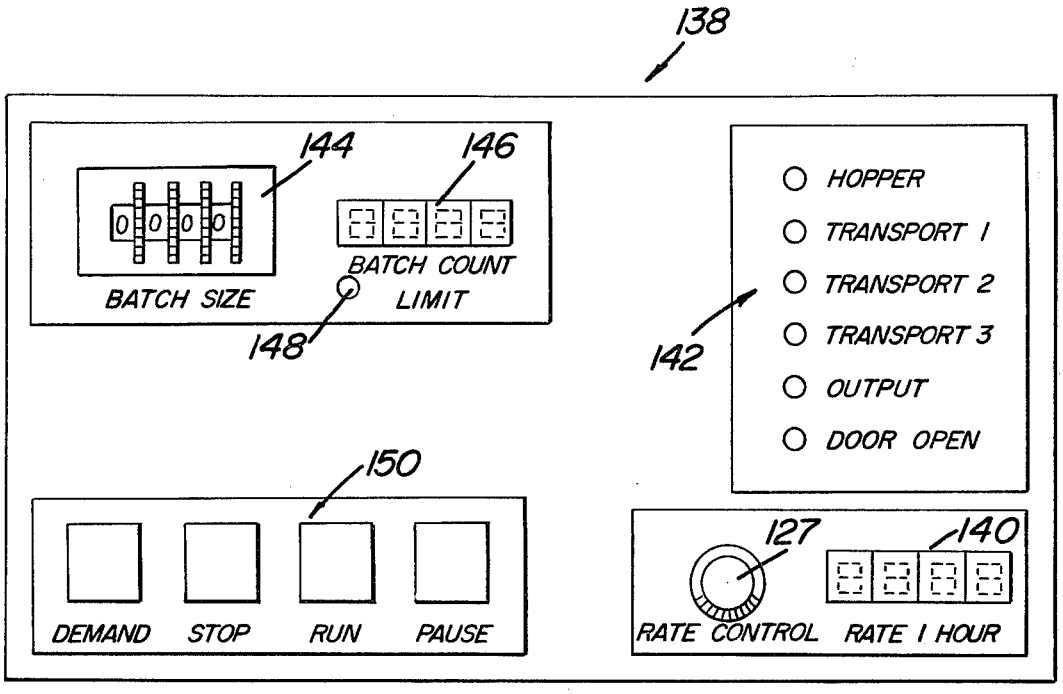
FIG. 17 is a drawing of the control panel.

The foregoing sequence of events defines a single machine cycle. The rate at which envelopes can be processed by the machine is determined by the rate of repetition of the machine cycle. Accordingly, the rate at which the machine can process envelopes is determined by varying the delay interval Tr between machine cycles. The delay interval Tr is varied by means of a rate control dial 127 at the machine control panel. See FIG. 17.

Rate Control

Figure 23:
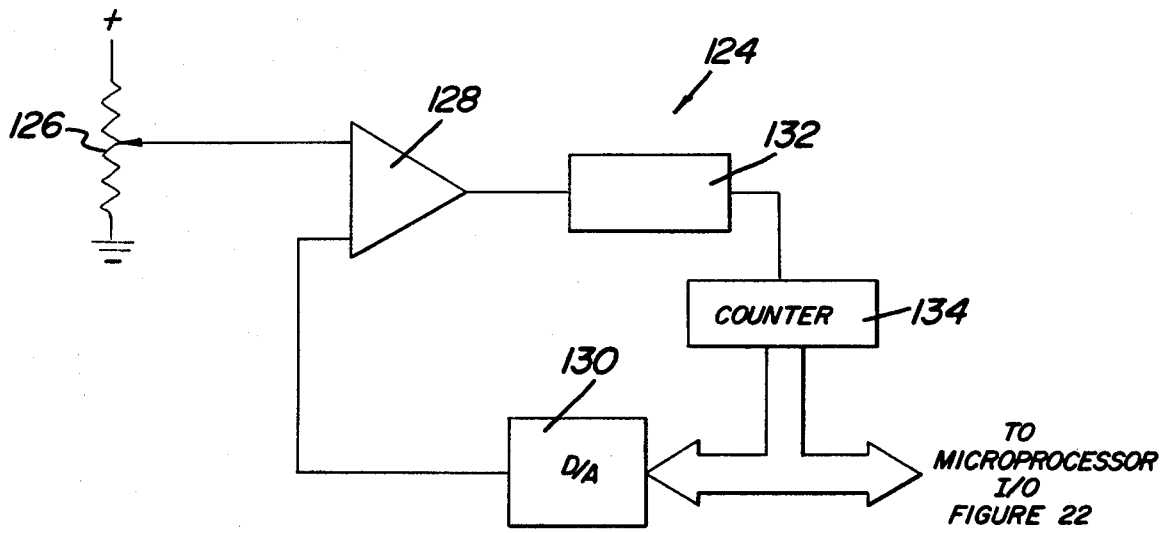
FIG. 23 is a block diagram of the rate control circuit.

Referring to FIG. 23, there is shown a rate control circuit 124 for controlling the repetition rate of the machine cycles. A rate control potentiometer 126 is operated by dial 127 located on the control panel. The potentiometer output is continuously compared by comparator 128 to the output of D/A converter 130. The output of comparator 128 gates a clock oscillator 132. The clock oscillator 132 increments a counter 134. The digital output of the counter 134 is converted by D/A converter 130 to an analog signal which is fed back to the comparator 128 and compared to the setting of potentiometer 126. The counter output represents the delay interval Tr between machine cycles. This output is scanned by the microprocessor.

When power is first applied to the envelope opener, an envelope is gripped by cups 14 and deposited at time Tf on conveyor 22. See chart (d) in FIG. 19. It takes one machine cycle for the envelope to reach the first shear station 26 and to be cut by shear barrel 28 at the station. See chart (f) in FIG. 19. During the following machine cycle, the envelope is processed through second shear station 38 where the opposite edge of the envelope is sheared. During the next machine cycle, the envelope is processed through third shear station 50 where the top edge is sheared. See chart (h) in FIG. 19. In the fourth machine cycle, the envelope is processed through peel back station 58 where the top panel of the envelope is peeled back by cup 66 and the contents of the envelope are exposed. Thus, it takes four machine cycles to process a single envelope through the machine.

During continuous operation of the machine, an envelope is deposited on conveyor 22 during each machine cycle. Each of the shear stations 26, 38 and 50 and the peel back station 58 will have an envelope present for processing. The peel back station will deliver a sheared and opened envelope at the end of every machine cycle. Accordingly, the rate at which the envelopes are processed is the inverse of the delay interval Tr between machine cycles. For the maximum processing rate, the delay Tr is approximately 0 seconds. If the machine cycle is assumed to be P0 seconds long, the maximum processing rate is therefore 1/P0 envelopes per second.

Microcomputer Interfacing

Interfacing between the machine components and the microcomputer is shown in FIG. 22. The microcomputer is designated generally as 136 and is an off-the-shelf item programmed to monitor the envelope opener as previously described. A typical program for controlling the microcomputer is annexed hereto as an addendum. The invention is not directed per se to such a program although it is understood that a microcomputer programmed in this manner will monitor the envelope opener components as described herein. Other programs, including obvious modifications to the program annexed hereto, may be employed without exceeding the spirit or scope of the invention.

The microcomputer 136 scans the light sensors and microswitches associated with the various machine stations to determine whether a jam condition has occurred at or between any of the stations. Detection of a jam condition as an envelope is being processed through a station has already been described. Detection of a jam condition between stations is described below.

The microcomputer scans and stores the states of the sensors and the microswitches during every machine cycle. This information is used by the microcomputer to determine the position of every envelope being processed by the machine. During the first machine cycle, the microcomputer detects the states of the sensors and microswitches and stores the information in temporary memory such as the cpu registers. In the first machine cycle, an envelope deposited on conveyor 22 is detected by light sensor 21 adjacent the conveyor. The conveyor transports the envelope to the first shear station 26. As the envelope enters the shear station, the leading edge of the envelope causes microswitch 118 to be triggered as already described. Thus, during the first machine cycle, the microcomputer stores the states of sensor 21 and microswitch 118 at the times they are actuated.

The microcomputer initiates the next machine cycle provided that no jam condition is indicated within a predetermined window, preferably 2 seconds, following the termination of the first machine cycle. If the envelope is jammed between stations 26 and 38, the microswitch 83 at shear station 38 will not be triggered within the 2 second window. The microcomputer detects this condition and actuates a display to indicate a jam condition while shutting down the main motor drive 102.

During the second machine cycle, the envelope is processed through the second shear station 38. The microprocessor detects release of microswitch 83 by the trailing edge of the envelope and stores this information in temporary memory. If the leading edge of the envelope does not trigger microswitch 98 at the third shear station 50 within another 2 second window, the microcomputer causes the display to indicate a jam condition and shuts off the main motor drive 102.

When the trailing edge of the envelope releases microswitch 64 at the third shear station, the microcomputer stores this information. The microcomputer then sets another window within which the leading edge of the envelope is expected to trigger microswitch 75 at the peel back station 58. If microswitch 75 is not triggered by the leading edge of the envelope within this window, the microcomputer causes the display to indicate a jam condition and shuts down the main motor drive 102.

Control Panel

The envelope opener includes a control panel 138. See FIG. 17. The control panel is provided with a rate control dial 127 coupled to potentiometer 126 in rate control circuit 124. See FIG. 23. The rate control dial 127 is adjusted by the operator to vary the delay interval Tr between machine cycles as already explained. The delay interval Tr is read off the output of counter 134 by the microcomputer. The microcomputer computes the processing rate based on the selected interval Tr and operates a four digit display 140 to display the computer rate. See FIG. 17.

A series of miniature lamps 142 is provided on the face of the control panel for indicating the position at which an envelope is jammed in the machine. Each of the lamps is connected to the I/O interface of the microcomputer 136. The microcomputer determines the address of the input port at which a jammed condition is indicated by the sensors and/or microswitches. One or more of the lamps 142 is actuated to indicate the jam condition and the location of the jammed envelope based on the input port addresses. For example, a jam condition may be indicated at the microcomputer input ports connected to feed station sensor 21 and first shear station microswitch 118 as already described. Under these conditions, the microcomputer 136 will activate the "Hopper" lamp. In general, if any of the other sensor-microswitch combinations 85–83, 87–92 and/or 89–110 indicate a jam condition at the microcomputer input ports, the microcomputer will activate the "Transport 1", "Transport 2" and/or "Transport 3" lamps, respectively. Similarly, if a jam condition is indicated by microswitch 81 at the peel back station 58, the microcomputer will activatethe "Output" lamp.

The control panel is also provided with set of thumb wheel switches 144. These switches are manipulated by the operator to indicate the size of the batch of envelopes to be processed by the machine. As each envelope is processed and delivered by the machine, the envelope triggers microswitch 75 at peel back station 58. The microcomputer counts the number of times that microswitch 75 is triggered. This corresponds to the number of envelopes processed by the machine. This count is used by the microcomputer to drive a four digit display 146. Display 146 provides a running indication of the number of envelopes processed by the machine. The microcomputer compares the setting of thum wheel switches 144 to the count indicated by display 146. When equality of the thumb wheel switches and display count is detected by the microcomputer, the microcomputer actuates a lamp 148 to signal to the operator the completion of a batch operation.

The microcomputer also scans a series of pushbutton switches 150 on the control panel 138. These pushbuttons may be used to signal any number of desired sequences of operation for the microcomputer. The microcomputer itself is programmed to respond to each of the switches as may be desired. For example, if the "Pause" pushbutton switch is depressed, the microcomputer will prevent the machine from executing another machine cycle after the current machine cycle is completed. Various other modes of operation of the machine may be effected by the microcomputer in response to external pushbutton signals or the like by providing appropriate programming for the microcomputer.

Detailed Mechanical Operation

A. Feed Station 12

Figure 8:
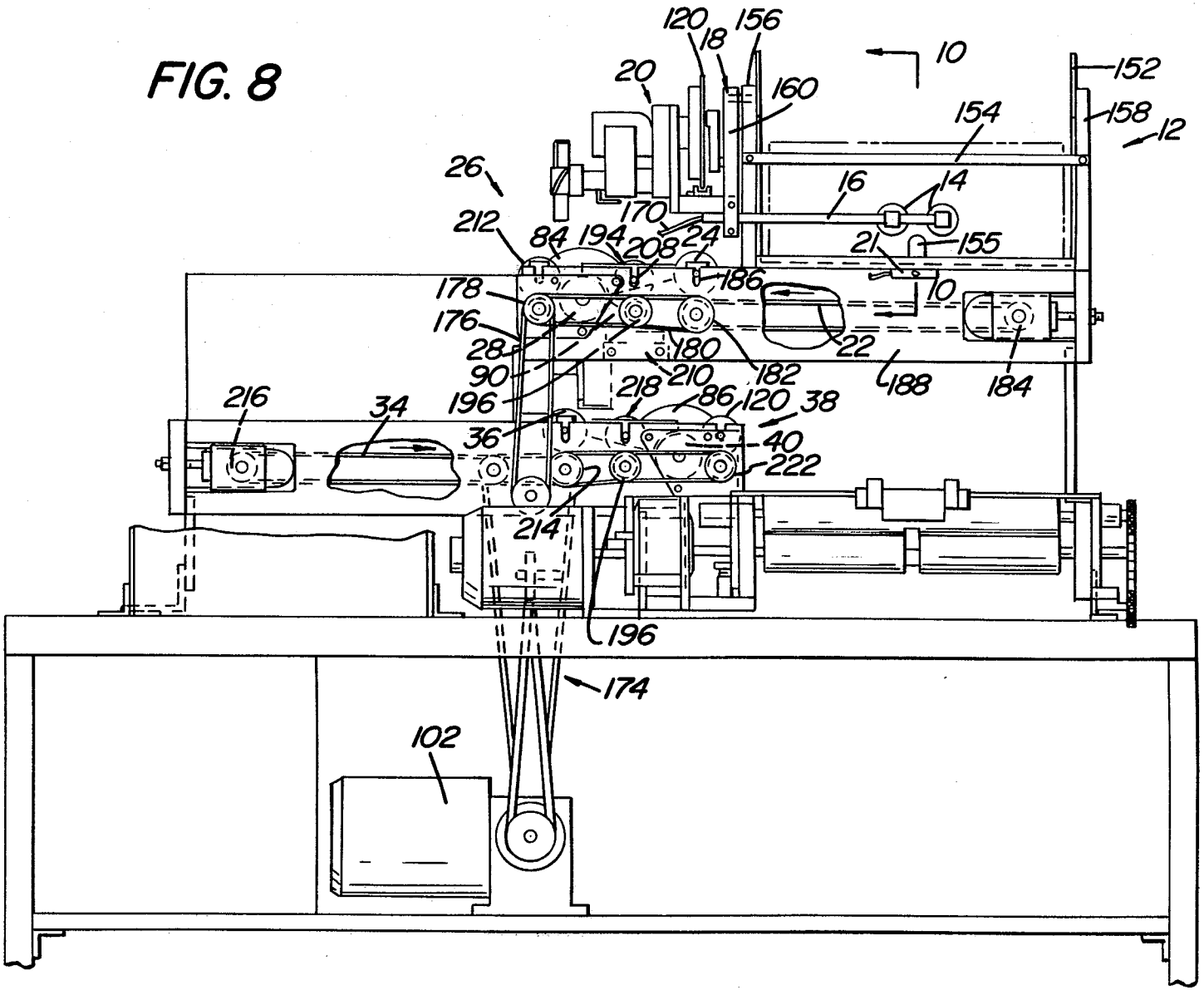
FIG. 8 is a front view of the envelope opener taken along the lines 8—8 in FIG. 7.
Figure 10:
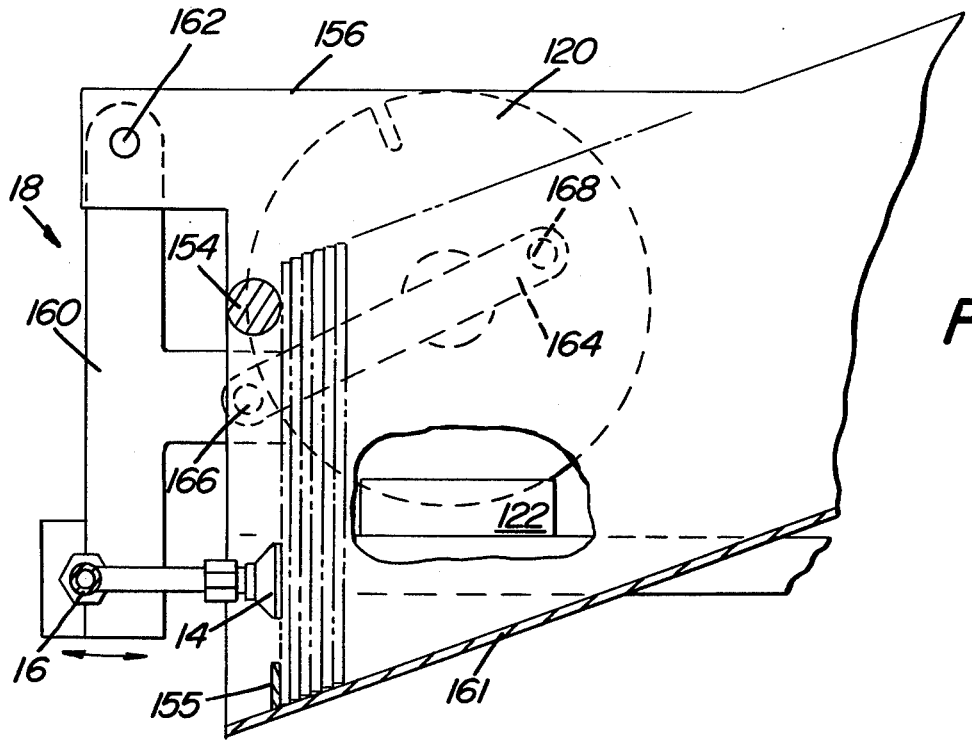
FIGS. 10 and 11 are details of the feed station in operation.

A batch of envelopes is loaded into a hopper 152 at feed station 12. See FIG. 8. The envelopes are held in position by a horizontal bar 154 and finger 155 fastened to side supports 156, 158 and bottom plate 161, respectively. The pair of suction cups 14 are secured to rod 16. Rod 16 is secured to a first pivotable member 160. Member 160 is pivotably mounted at pivot 162 on side support 156. See FIGS. 10 and 11. The first pivotable member 160 is also pivotably connected to a second pivotable member 164 at pivot 166. Second pivotable member 164 is pivotably mounted on timing disk 120 at an eccentric pivot 168. First and second pivotable members 160 and 164 comprise the crank 18. The crank reciprocates the rod 16 along an arc centered about pivot 162 in response to rotation of the fiming disk 120 under power of motor 20.

A pressure conduit 170 such as flexible tubing or the like connects the rod 16 to the solenoid valve 172. See FIG. 8. Rod 16 is hollow and serves as a conduit between the suction cups and the tubing 170. At the beginning of a machine cycle, the microcomputer continuously operates the solenoid valve 172 in the open state so that suction pressure is applied through tubing 170 and rod 16 to cups 14. The motor 20 rotates rod 16 to bring suction cups 14 into contact with the first envelope in the batch. The suction cups grip the envelope and swing the envelope between bar 154 and finger 155 away from the feed station as shown in FIG. 11.

Figure 11:
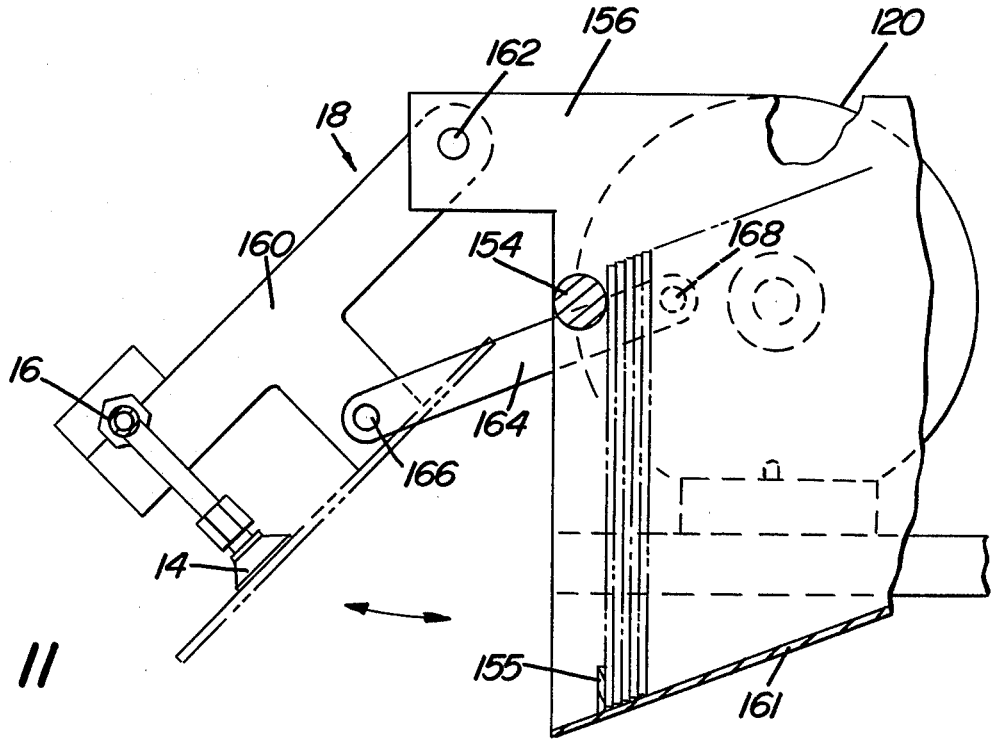

When first pivotable member 160 reaches the position shown in FIG. 11, the slot in timing disk 120 should be aligned with sensor 122. This occurs at time Tf as already explained in connection with chart (d) in FIG. 19. The microcomputer detects alignment of the slot and sensor and causes the solenoid valve 172 to close to remove the suction pressure from cups 14. The cups release the envelope, and the envelope drops onto conveyor 22. B. First Shear Station 26

Conveyor 22 is driven by main motor drive 102 via chain and sprocket assembly 174, belt 176, driving roller 178, belt 180 and driven roller 182. See FIGS. 6 and 8. Conveyor belt 22 is driven about idler roller 184 by driven roller 182. See FIG. 8.

The envelope is transported on conveyor belt 22 to grooved roller 24 at the entrance to the first shear station 26. Grooved roller 24 is mounted in notches 186, 186' in side panels 188, 188' respectively. The notches permit vertical displacement of the roller to accommodate varying envelope thicknesses.

The roller 24 is provided with plural ribs 190 which define a series of grooves 192. See FIG. 18. The ribs and grooves serve to smooth out any ruffles or bent edges in an envelope entering between rollers 24 and 182 at the first shear station.

Figure 7:
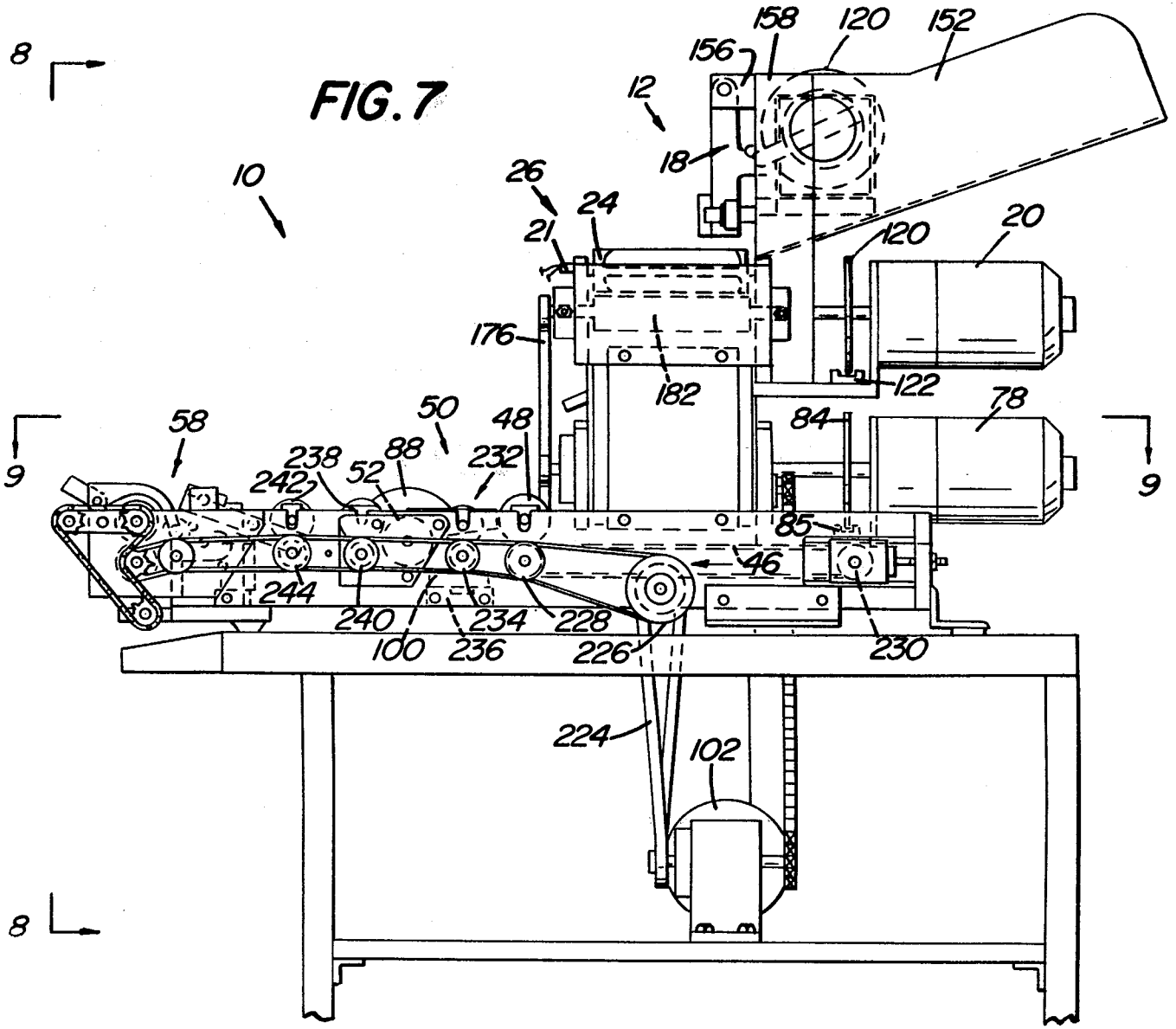
FIG. 7 is a right side view of the envelope opener taken along the lines 7—7 in FIG. 6.

As the envelope passes through the shear station, it is monitored by the microcomputer. The microcomputer detects the action of feeler arm 114 on shaft 112 as already explained. See FIGS. 6 and 13. The feeler arm 114 is disposed upstream of idler means 194 and drive roller 196. See Figs. 8 and 13. Idler means 194 comprises a housing 198 having plural passages 200 in side-by-side relation and an inclined bottom surface. See FIG. 13. A rotatable shaft 202 is mounted in opening 204. the shaft 202 and opening 204 extend through the housing 198 perpendicular to the direction of travel of the envelope. The opening 204 connects the passages 200. An idler roller 206 is mounted in each passage 200 on shaft 202. Shaft 202 is mounted in notches 208, 208' in panels 188, 188' respectively. See FIGS. 7 and 8. Accordingly, idler rollers 206 may be displaced vertically to accommodate varying thickness of envelopes.

The envelope passes between idler means 194 and roller 196 and travels toward shear barrel 28. The leading edge E of the envelope abuts against the shear barrel 28. See FIG. 13. The rollers 194 and 196 cooperate with the barrel 28 to align the envelope in this position. The inclined bottom surface of housing 198 keeps the leading edge of the envelope in position adjacent the shear barrel and anvil.

When the envelope has been aligned, the shear barrel 28 rotates to ring shear blade 30 into contact with the leading edge E. As the blade travels towards the leading edge, it slides against an arcuate surface 197 at the portion of housing 198 facing the barrel. The shear blade 30 cooperates with anvil 90 to shear the leading edge. Anvil 90 is mounted on an adjustable block end screw assembly 210. The block end screw assembly 210 permits adjustment of the lateral position of the anvil 90 to assure accurate and complete shearing of the leading edge.

The shear blades 30, 30' are secured to the shear barrel 28 as shown in FIGS. 13 and 15. The shear blades are skewed with respect to the longitudinal axis of the barrel. This ensures an accurate shearing action when a blade contacts the anvil 90. It also reduces the amount or torque required to shear the envelope edge since a blade contacts only one point on the envelope edge at any given instant of time.

After the leading edge E of the envelope is sheared, the envelope passes through the longitudinal barrel opening 32 through idler roller 212 and and driven roller 178. See FIG. 8. The envelope leaves rollers 212 and 178 and drops onto conveyor belt 34.

c. Second Shear Station 38

The main motor drive 102 drives conveyor 34 by the chain and sprocket assembly 174 and driven roller 214. See FIG. 8. The conveyor belt 34 is driven about roller 216 by a driven roller 214.

Conveyor belt 34 transports the envelope to the grooved roller 36 and the driven roller 214. Grooved roller 36 is identical to grooved roller 24. Roller 36 smooths out any ruffles or bent edges in the envelope. The smoothed envelope moves past the roller to idler means 218 and driven roller 196. Idler means 218 is identical to idler means 194. Idler means 218 cooperates with barrel 40 to align the envelope for shearing with the leading edge of the envelope abutting the barrel. The microcomputer scans microswitch 83 associated with actuator arm 69 at the second shear station to determine when the envelope should be sheared. The microswitch 83 anc actuator arm 69 are operated in the same fashion as the microswitch 118 and actuator arm 116 in first shear station 26. The feeler arm and shaft assembly associated with the actuator arm 69 is the same as that shown in FIG. 13.

The envelope is sheared by shear blades 42, 42' on barrel 40 in cooperation with an adjustable anvil assembly as shown in FIG. 13. After the envelope is sheared, it passes through the longitudinal opening 44 in barrel 40 to idler roller 220 and driven roller 222. The envelope passes through rollers 220 and 222 and is dropped onto conveyor belt 46.

D. Third Shear Station 50

Conveyor belt 46 is driven by main motor drive 130 via twisted belt 224, pulley 226 and rollers 228 and 230. See FIG. 7. The envelope is transported by conveyor belt 46 to grooved roller 48 and roller 228. Grooved roller 48 smoothes out any ruffles in the envelope and passes the envelop to idler means 232 and driven roller 234. Idler means 232 is identical to idler means 194. The envelope passes between idler means 232 and roller 234 and is temporarily arrested in position with the leading edge of the envelope abutting against the shear barrel 52. Shear barrel 52 is identical to barrel 28. In this position, the envelope is aligned for shearing.

Figure 9:
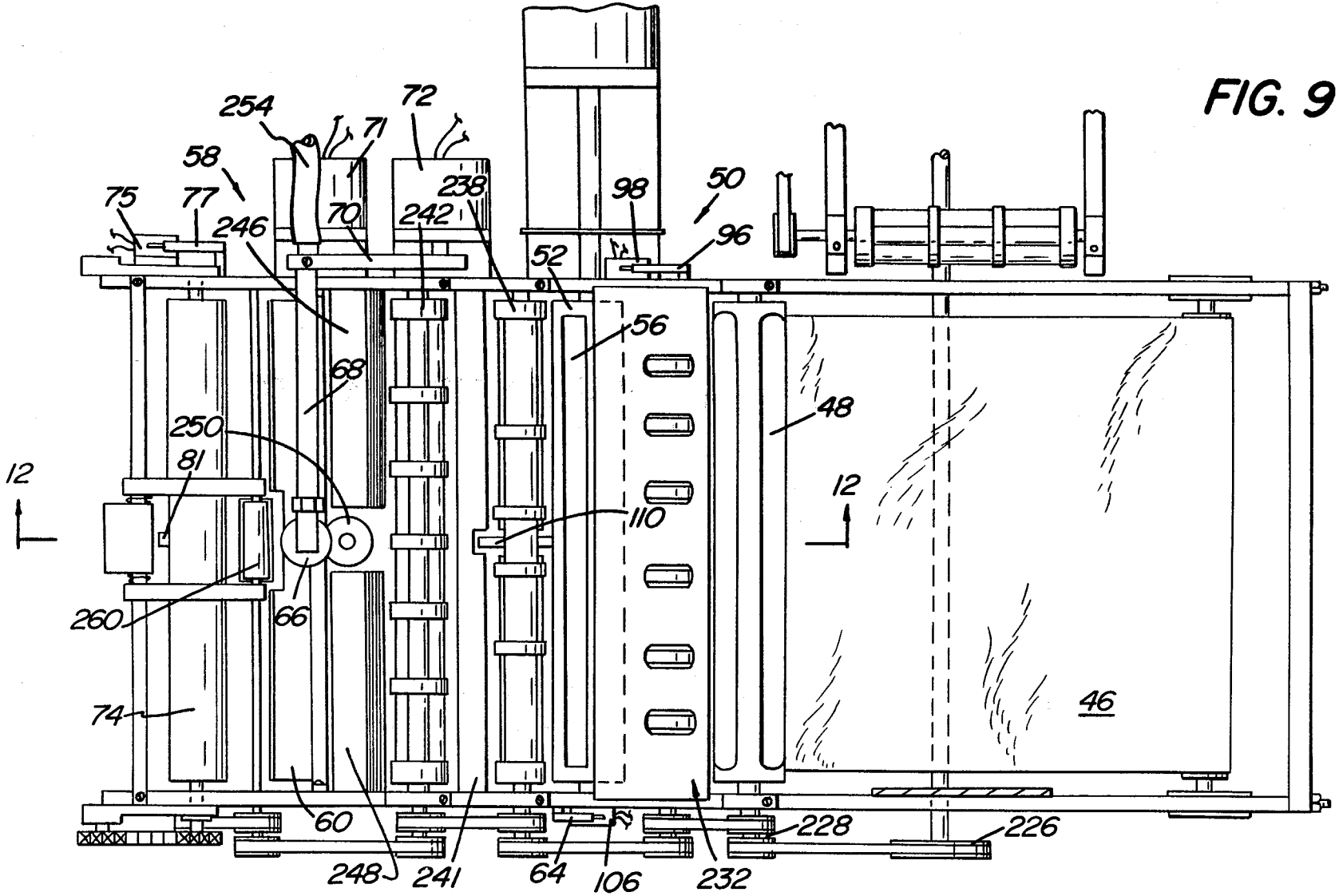
FIG. 9 is a plan view of the third shear station and the peeler back station.

The microcomputer scans microswitch 98 associated with actuator arm 96 at the third shear station as already explained. See FIG. 9. The actuator arm is connected to the shaft 94. See FIG. 12. The feeler arm 92 is secured to shaft 94 and is depressed by the envelope as it passes through idler means 232 and roller 234 as already explained.

When the envelope is aligned for shearing, the microcomputer causes the barrel 52 to be rotated. Shear blade 54 cooperates with anvil 100 to shear the leading edge of the envelope. The lateral position of the anvil 100 may be adjusted by means of block and screw assembly 236. See FIG. 12.

After the leading edge of the envelope has been sheared, the envelope passes through barrel opening 56 to idler roller 238 and driven roller 240. As the envelope leaves rollers 238 and 240, it depresses feeler arm 110 mounted on shaft 108. As a result, actuator arm 160 triggers microswitch 64 as already explained. See FIGS. 9 and 12. The microcomputer scans microswitch 98 to detect any jam condition at third shear station 50. The envelope passes over an elongated table 241 to idler roller 242 and driven roller 244. See FIGS. 9 and 12. The envelope passes between rollers 242 and 244 to spaced tables 246 and 248 at peel back station 58. See FIG. 9.

E. Peel Back Station 58

Figure 16:
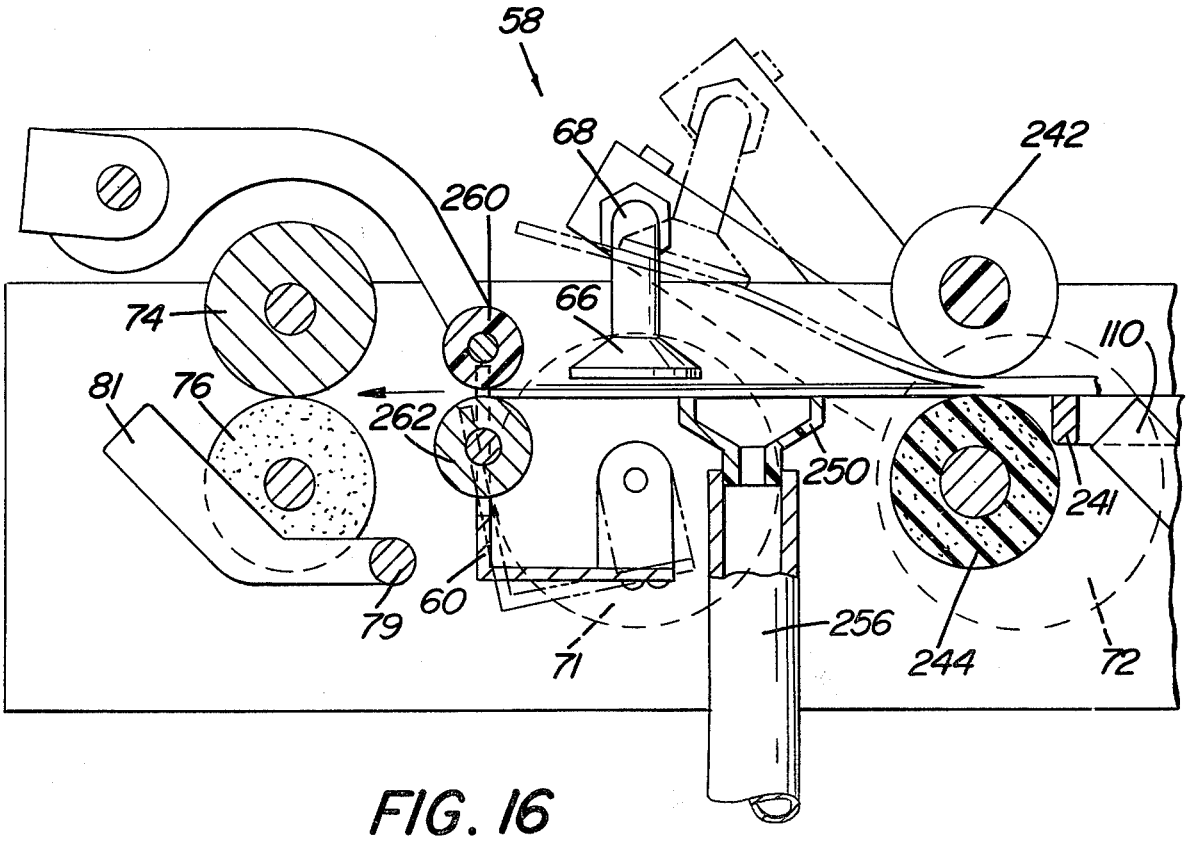
FIG. 16 is an enlarged cross-section of the peel back station in operation.

The envelope passes over the tables 246 and 248. The leading edge of the envelope abuts against swingable gate 60 operated by solenoid 71. See FIGS. 9 and 16. The gate 60 and rollers 242 and 244 arrest the envelope in the position shown in FIG. 16.

The envelope is sandwiched between suction cups 66 and 250. Section cup 66 is coupled through hollow rod 68 and pressure conduit or tubing 254 to solenoid valve 258. See FIGS. 9 and 16. At time Tf, the microcomputer opens valve 258 to apply suction pressure to cups 66 and 250. See chart (k) in FIG. 19. Suction cup 66 grips the top panel of the envelope. Suction cup 250 grips the bottom panel of the envelope. Suction is applied to cup 250 via a conduit 256. The suction pressure applied to cup 250 is somewhat stronger than the pressure applied to cup 66. The suction applied to cup 250 is made stronger than the suction applied to cup 66 to prevent an unsheared envelope from being lifted by cup 66. If an unsheared envelope were lifted and then released by cup 66, it would become jammed at the peel back station. If the envelope has been properly sheared, suction cups 66 and 250 separate the top and bottom panels of the envelope.

Rod 68 is secured to linkage arm 70 which is raised and lowered by solenoid 72. See FIGS. 9 and 16. After suction pressure is applied to cup 66, the solenoid 72 is actuated by the microcomputer to raise rod 68 via linkage arm 70 to the position shown in broken lines in FIG. 16. The top panel of the envelope is peeled back by suction cup 66 as the rod 68 is raised to this position. The stronger suction pressure applied to cup 250 retains the bottom panel of the envelope in position during this time.

After the top panel of the envelope has been peeled back by cup 66, the microcomputer operates solenoid valve 258 to remove the suction pressure from the cups 66 and 250. Thereafter, the microcomputer operates solenoid 71 to lower the gate 60 to the position shown in broken lines in FIG. 16. The top panel of the envelope drops onto spring-loaded roller 260. The bottom panel of the envelope passes between the spring loaded roller and driven roller 262. The bottom panel of the envelope thereafter passes between ironing rollers 74 and 76 and over feeler arm 81 to the delivery end of the machine. The peeled back top panel of the envelope also travels between spring loaded roller 260 and driven roller 262 and ironing rollers 74 and 76 over the feeler arm 81. When the feeler arm 81 is depressed by the passing panel of the envelope, the actuator arm 77 triggers microswitch 75 to indicate to the microcomputer that an envelope has been opened by the machine.

An advantage of the invention is that each edge of the envelope is sheared in sequence, each edge being precisely aligned by a shear barrel. Auxiliary structure for guiding and aligning the envelope is eliminated. In addition, the advance of the envelope is continuously monitored and any jam condition is rapidly detected by state of the art electronics. All jam conditions are indicated on a control panel display. Further, the invention significantly increases the rate at which envelopes can be processed while permitting adjustment of that rate.

The present invention may be embodied in other specific forms without departing from the spirit or essential attributes thereof and, accordingly, reference should be made to the appended claims, rather to the foregoing specification, as indicating the scope of the invention.

We claim:

1. An envelope opener, comprising:

first means for transporting at least one envelope from a feed station to a delivery point, second means intermediate said feed station and delivery point for successively aligning and shearing at least three edges of the envelope one edge at a time, third means for monitoring the advance of the envelope from the feed station to the delivery point, and fourth means for detecting whether the envelope has advanced a preselected distance over at least one preselected interval of time and for automatically disabling said first and second means.

2. The envelope opener according to claim 1 including fifth means downstream of said second means for peeling back a panel of the envelope.

3. The envelope opener according to claim 1 including means for selectively varying the rate at which said second means aligns and shears the edges of the envelope.

4. The envelope opener according to claim 1 wherein said second means includes:

a first shear station for sequentially aligning the envelope by contacting a first edge thereof and shearing said first edge, a second shear station for sequentially aligning the envelope by contacting a second edge thereof opposite said first edge and shearing said second edge, and a third shear station for sequentially aligning the envelope by contacting a third edge thereof between said first and second edges and shearing said third edge.

5. The envelope opener according to claim 4 wherein each of said shear stations is provided with at least one sensor for detecting presence and absence of the envelope.

6. The envelope opener according to claim 4 wherein each of said shear stations includes a rotatable barrel having at least two spaced shear blades mounted thereon and an elongated opening intermediate said blades for permitting said envelope to pass therethrough.

7. The envelope opener according to claim 6 wherein at least one of said shear stations includes idler means disposed upstream of said rotatable barrel, said idler means being provided with plural rollers for contact with said envelope and an inclined bottom surface for keeping an edge of the envelope in position adjacent said barrel.

8. The envelope opener according to claim 3 wherein said rate varying means includes a counter, means for imcrementing said counter, a D/A converter for converting the output of said counter to an analog signal, an adjustable potentiometer, and a comparator for comparing the output of said potentiometer with the output of said D/A converter.

9. An envelope opener comprising:

a first conveyor belt for transporting at least one envelope in a first correction, a feed station disposed above said first belt for storing plural envelopes and for successively depositing the envelopes on said first belt, a first shear station disposed downstream of said first belt for sequentially aligning an envelope by contacting a first edge thereof and shearing said first edge, a second conveyor belt disposed below the elevation of said first shear station for transporting said envelope in a second correction opposite to said first direction, a second shear station disposed downstream of said second belt for sequentially aligning the envelope by contacting a second edge thereof and shearing said second edge, a third conveyor belt for transporting said envelope in a third direction transverse to said first and second directions, a third shear station disposed downstream of said third belt for sequentially aligning the envelope by contacting a third edge thereof and shearing said third edge, control means for causing said shear stations to successively align and shear said envelope edges one edge at a time, means for monitoring the advance of said envelope past said shear stations, and means for detecting whether the envelope has advanced a preselected distance over at least one preselected interval of time and for automatically stopping said conveyor belts.

10. The envelope opener according to claim 9 including means disposed downstream of said third shear station for opening said envelope by lifting a panel thereof.

11. The envelope opener according to claim 9 including means for selectively varying the rate at which said control means causes said shear stations to successively align and shear said envelope edges.

12. The envelope opener according to claim 9 wherein each of said shear stations is provided with a sensor for detecting the presence and absence of an envelope.

13. The envelope opener according to claim 9 wherein each of said shear stations includes a rotatable barrel having at least two spaced shear blades mounted thereon for shearing an envelope and an elongated opening intermediate said blades for permitting said envelope to pass therethrough.

14. The envelope opener according to claim 13 wherein at least one of said shear stations includes idler means provided with plural rollers for contact with said envelope and an inclined bottom surface for keeping an edge of the envelope in position adjacent said barrel.

15. A method of automatically opening an envelope, comprising:

(a) automatically transporting at least one envelope from a feed station to a delivery point, (b) automatically aligning the envelope as it is being transported between said feed station and delivery point by contacting an edge thereof and then shearing the contacted edge, (c) cyclicly repeating step (b) to successively shear at least three edges of the envelope one edge at a time, (d) automatically monitoring the advance of said envelope from the feed station to the delivery point, and (e) automatically detecting whether said envelope has advanced a preselected distance over at least one preselected interval of time and automatically inhibiting said steps (a)-(c).

16. A method according to claim 5 including (f) automatically opening said sheared envelope by lifting a panel thereof.

17. A method according to claim 15 including (g) selectively varying the rate at which said step (b) is cyclicly repeated.

* * * * *